US005676126A

United States Patent [19]

Rupprecht et al.

[11] Patent Number: 5,676,126

[45] Date of Patent: Oct. 14, 1997

[54] MASONRY SLITTING APPARATUS

[75] Inventors: Hans Rupprecht, München; Armin Below, Kaufering, both of Germany

[73] Assignee: Hilti Aktiengesellschaft, Fürstentum, Germany

[21] Appl. No.: 627,239

[22] Filed: Apr. 1, 1996

[30] Foreign Application Priority Data

Mar. 30, 1995 [DE] Germany ..... 195 11 725.5

[51] Int. Cl.[6] ..... E21C 47/00

[52] U.S. Cl. ..... 125/13.03; 125/13.01; 125/14

[58] Field of Search ..... 125/12, 13.01, 125/13.03, 14

[56] References Cited

U.S. PATENT DOCUMENTS 4,502,251 3/1985 Everett ..... 125/13.03

5,172,680 12/1992 Swan ..... 125/13.03

5,241,946 9/1993 Yelton et al. ..... 125/13.01

FOREIGN PATENT DOCUMENTS 3815245 11/1989 Germany .

*Primary Examiner*—Eileen P. Morgan

*Attorney, Agent, or Firm*—Anderson Kill & Olick, P.C.

[57] ABSTRACT

A masonry slitting apparatus includes a housing (1) containing a drive unit (2) for a slitting tool (4) and a trolley (3) to which the housing is pivotally connected by a rotary bearing (6) located in a first end region of the housing and trolley. The trolley (3) has a locking rail projecting toward the housing in a second end region with an adjustable depth stop (18) located on the locking rail (17). The housing (1) has a locking pawl (12) cooperating with the locking rail (17) and the pawl is actuated by a locking switch (11) in a handle (9) on the housing (1). The depth stop (18) has a locking arm (28) for securing the housing in a working position.

5 Claims, 2 Drawing Sheets

MASONRY SLITTING APPARATUS

BACKGROUND OF THE INVENTION

The present invention is directed to a masonry slitting apparatus with a housing having two handles and containing a drive unit for a slitting tool comprising at least one disk. The housing is pivotally mounted relative to a trolley with pivotal movement parallel to a disk plane of the slitting tool and pivotally displaceable around a rotary bearing in a first end region of the housing against a biasing force of a spring. In a second end region of the trolley a locking rail mounts an adjustment depth stop and the rail projects in the direction of the housing. The housing has a locking pawl cooperating with the locking rail and the locking pawl can be actuated by a locking switch disposed in one of the handles on the housing.

Electrical conduits must be laid in the electrical installations for new buildings, renovated buildings or additions to existing buildings and the conduits serve for receiving individual electric cables. In concrete structural members, such as floors, ceilings or walls, the electric conduits or ducts are fastened, as a rule, in form work before concrete is poured into the form work. For placing the electric conduits in masonry walls protruding from the concrete structural members, masonry slitting tools are used for forming two slits running parallel to one another. The depth and the spacing of the two slits depends upon the number and diameter of the electric cables to be installed. The portion of the masonry wall located between the slits is broken out by means of a suitable breakout tool, so that a receiving groove for the electric conduits is formed.

A slitting apparatus including a housing, a drive unit in the housing for a slitting tool comprising at least one disk and a trolley is disclosed in DE-OS 38 15 245. In its initial position, the housing is in an inclined position relative to the trolley, so that the slitting tool does not project beyond the trolley resting on the material to be worked. The housing can be pivoted parallel to a disk plane of the slitting tool into a working position against the force of a spring element around a rotary bearing disposed in a first end region of the trolley with a locking rail projecting from the trolley in the direction housing and resting with its free end at a locking tongue or end of a locking pawl located in the housing for limiting the pivotal movement between the housing and the trolley. The locking pawl is connected to a locking switch located in one of the handles and when actuated causes the locking pawl to turn around its axis whereby the locking tongue or pin turns in the same way against the force of a spring element. If the locking switch is released, the locking pawl returns back to its initial position. A depth stop is disposed on the locking rail and can be adjusted step-wise along the rail.

In this known apparatus, the operator must supply a part of the high-contact pressure force necessary for the slitting procedure and also the force required during the entire slitting process for compressing the spring located between the trolley and the housing. This additional force results rapidly in fatigue phenomenon, so that the contact pressure force declines. As a result, slits of different depths are cut.

SUMMARY OF THE INVENTION

Therefore, the primary object of the present invention is to provide a masonry slitting apparatus affording fatigue free, simple and safe fabrication of slits with a constant depth in material to be worked, in particular masonry.

In accordance with the present invention, the problems experienced previously can be avoided with the depth stop being fixed at the locking pawl.

The housing is pivoted relative to the trolley and, as a result, relative to the locking rail for movement to a position for cutting slits in the material to be worked. As soon as the housing comes to rest at the depth stop, the depth stop is fixed at the locking pawl of the housing. Lifting the housing from the depth stop is not possible, although the spring disposed between the housing and the trolley is under prestress. Accordingly, an additional force for the spring does not have to be applied during the slitting procedure. Preferably, the securement of the housing to the depth stop occurs by means of a locking arm projecting in the direction of the locking pawl and cooperating with a stop on the locking pawl.

Preferably, the locking pawl is provided with a guidance cam surface causing a resilient yielding of the locking arm. Therefore, the locking arm is displaced sideways as the housing is pivoted relative to the trolley prior to establishing the connection between the locking arm and the stop.

The stop located on the locking pawl is formed by a stop face directed away from the locking rail or the trolley. The free end of the locking arm is bent off at an angle and arranged essentially parallel to the stop face on the locking pawl. To effect this locking arrangement, one boundary face of the housing rests against the depth stop and the spacing between the depth stop and the locking pawl and the locking edge of the locking arm corresponds at least to the spacing between the boundary face on the housing facing depth stop and the stop on the locking pawl shaped as a stop face.

For operational reasons, the locking arm is preferably formed from spring steel.

The various features of novelty which characterize the invention are pointed out with particularity in the claims annexed to and forming a part of this disclosure. For a better understanding of the invention, its operating advantages and specific objects attained by its use, reference should be had to the drawing and descriptive matter in which there is illustrated and described a preferred embodiment of the invention.

DETAILED DESCRIPTION OF THE INVENTION

Figure 1:
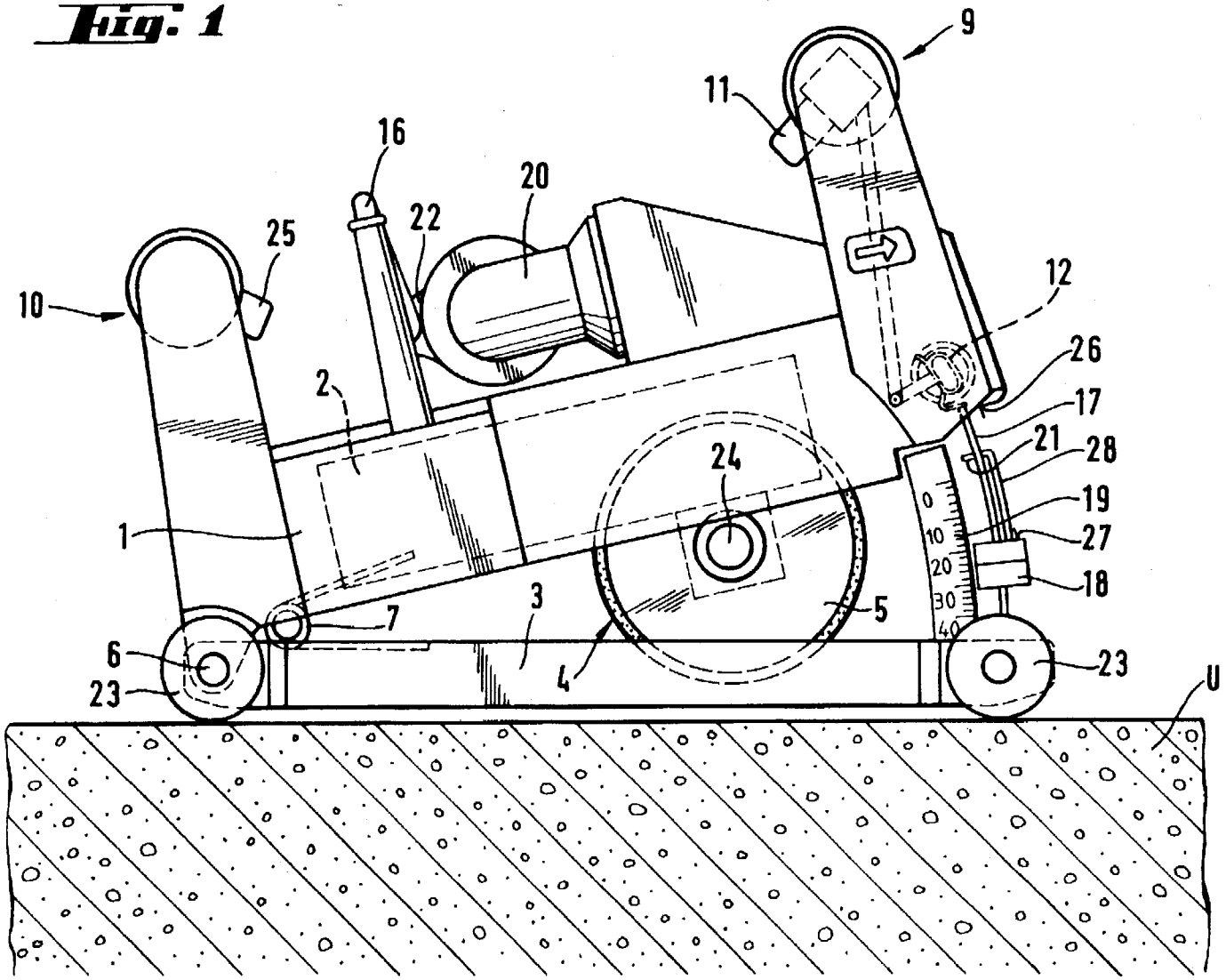
FIG. 1 is a side elevational view of a masonry slitting apparatus embodying the present invention and illustrated in the non-operational position.

In FIG. 1 a masonry slitting apparatus is shown made up of a housing 1, a drive unit 2 mounted in the housing 1 for operating a slitting tool 4 having at least one disk, and a trolley 3. The housing 1 has a first end, the left-hand in FIG. 1 and a second end, the right-hand end in FIG. 1. Further, the housing has sides extending between the two ends, whereby the housing is rectangular in shape. The trolley 3 has the same general configuration as the housing 1 and has a first end and a second end with sides extending between the ends. The housing can be pivoted relative to the trolley 3 against the force of a spring 7 with the pivotal movement of the housing being parallel to a disk plane of the slitting tool 4. The housing is pivotally displaceable relative to the trolley about a rotary bearing 6 located in the first end region of the housing and trolley.

Rollers 23 are located in the corners of the trolley 3 for facilitating displacement of the trolley over a surface of a material U to be worked. The rollers 3 are positioned for displacement of the trolley or the entire apparatus only in the direction extending parallel to the long extent of the apparatus, that is, in the direction of the sides of the trolley housing.

A gear box, not shown, is connected to the drive unit 2 and has an output shaft 24 extending at right angles to the sides of the housing with two disks 5 forming the slitting tool 4 and being secured on the output shaft 24.

A suction unit 20 is located on the upper part of the housing 1 between the two handles 9, 10 and an electric cable 16 projecting from the housing can be clipped to the suction unit 20 between the handles 9, 10 by retention elements 22.

The housing 1 has a first handle 10 located in the first end region connected to the trolley 3 by the rotary bearing 6 and a second handle 9 located in the second end region.

The handle 10 located in the first end region of the apparatus has an electric switch 25 which, when actuated, turns on the drive unit 2.

The handle 9, located in the second end region of the housing, has a locking switch 11 which when actuated operates the locking pawl 12 for limiting the pivotal movement between the housing 1 and the trolley 3 against the biasing force of a spring element 8, note FIGS. 2–5. In the locked position of the locking pawl 12, shown in FIG. 2, the locking switch 11 has not be an actuated and a locking tongue or pin 13 of the locking pawl 12 abuts at the free end, that is the upper end, of a locking rail 17 projecting upwardly from the trolley 3 towards the housing 1.

A depth stop 18 has a clamping region, not shown, and is positioned on the locking rail 17 and can be adjusted step-wise along the locking rail. The clamping region cooperates in a positively locking manner with a toothed region 29 on the locking rail 17. The depth stop can be adjusted to a desired slit depth by means of an adjustment scale 19 projecting upwardly from the trolley 3, note FIG. 1.

Figure 3:
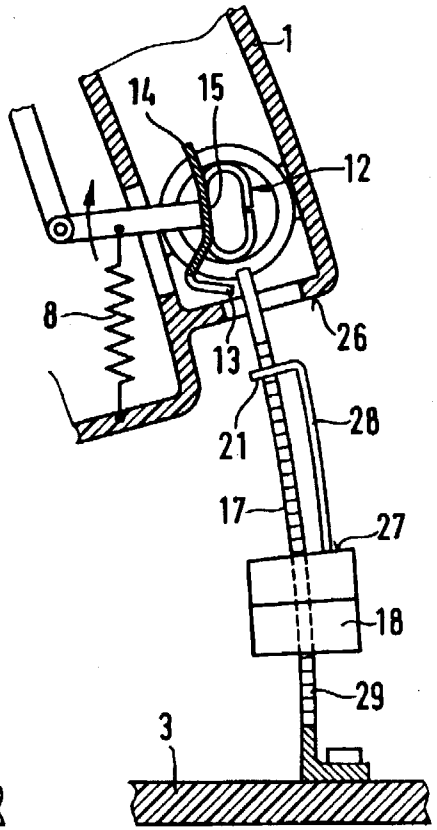

When the locking switch 11 is actuated, as shown in FIG. 3, the locking pawl is turned by means of transmission elements from the locked position into an open position. In such a displacement of the locking pawl, a locking tongue 13 on the lower end of the locking pawl 12 releases the locking rail 17 and the housing 1 can be pivoted relative to the locking rail and also to the trolley 3.

Figure 5:
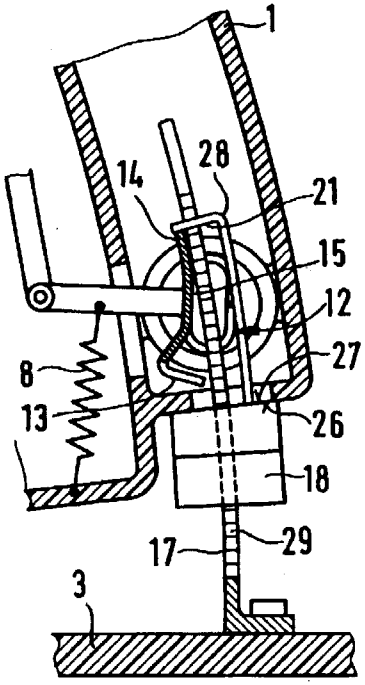

If, as shown in FIG. 5, a boundary face 26 of the housing 1, facing the depth stop 18 contacts a stop face 27 of the depth stop 18 on the locking rail 17, the housing 1 is fixed relative to the depth stop 18, and is adjusted to the desired slit depth for as long as the locking switch 11 is actuated. The slitting apparatus is thus in the working position and the disks 5 of the slitting tool 4 project downwardly below the trolley 3 resting on the material U to be worked by an amount which can be read from the adjustment scale 19. The fixed position of the housing 1 at the depth stop 18 is effected by the depth stop 18 which comprises an upwardly extending locking arm 28 projecting towards the locking pawl 12 and cooperating with a stop 14 located at the upper end of the locking pawl 12. Stop 14 is formed as stop face directed away from the locking rail 17 on the trolley 3. The upper free end of the locking arm 28 is bent approximately at a right angle with the remainder of the arm and is shaped to be essentially parallel to the stop 14 and forms stop edge 21 extending parallel to the stop 14 on the locking pawl 12. Stop edge 21 enables a gripping contact with the stop 14 and thus affords a fixation of the housing 1 at the depth stop 18 and the trolley 3.

Figure 4:
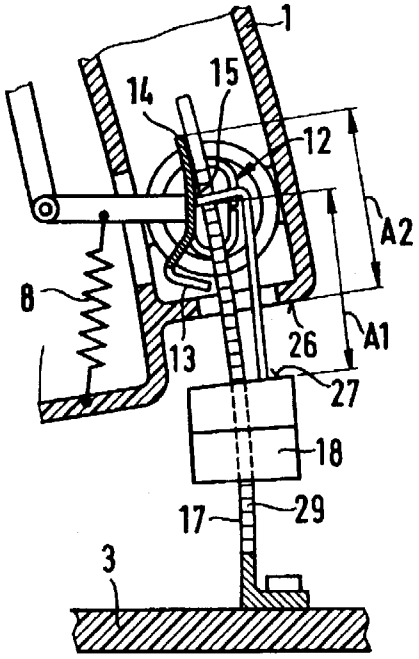

As shown in FIG. 4, the gripping of the stop 14 on the locking pawl 12 can occur only, if in the course of pivoting the housing 1 relative to the trolley 3, there occurs an essentially parallel displacement of the stop 14 relative to the stop edge 21 on the locking arm 28. The locking pawl 12 has a guidance cam surface 15 extending generally in the pivoting direction of the housing and results in a resilient yielding of the locking arm 28 with the simultaneous basically parallel displacement of the stop edge 21. During the pivotal movement of the housing 1, the bent off free end of the locking arm 28 rests along the guidance surface 15 of the locking pawl 12 and is displaced sideways by the pawl. As a result, the locking arm 28, formed of a resilient material, is pre-stressed. When the working position is reached, the boundary face of housing 1 rests or contacts a stop face 27 of the depth stop 18 and the free end of the locking arm 28 disengages from the guidance surface 15 of the locking pawl 12 and springs into its locking position and grips against the stop 14 on the locking pawl 12.

To obtain the gripping action of the stop 14 on the locking pawl 12, shaped as a stop face, by means of the stop edge 21 on the locking arm 28, if the boundary face 26 of the housing 1 rests at the depth stop, the spacing A1 between the stop face 27 of the depth stop 18 facing the locking pawl 12 and a stop face 21 of the locking arm 28 amounts advantageously to at least the spacing A2 between the boundary face 26 on the housing 1 facing the depth stop 18 and the stop 14 on the locking pawl 12, note FIG. 4.

Figure 2:
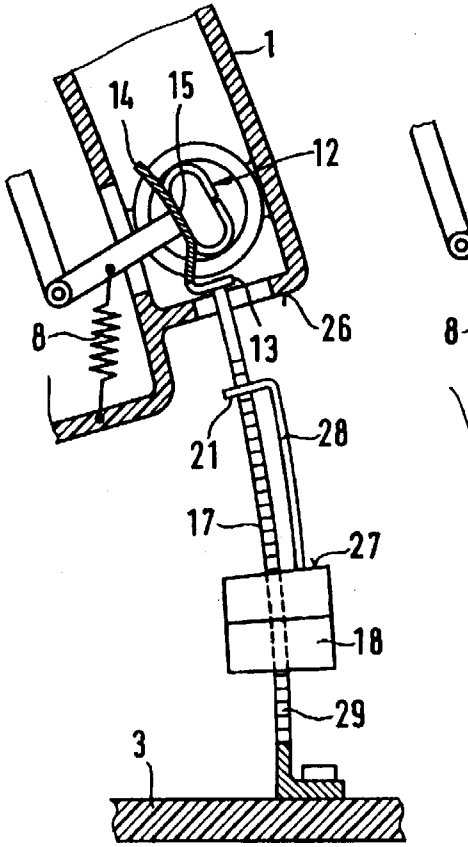
FIGS. 2–5 each illustrate a section of a locking mechanism of the masonry slitting apparatus in FIG. 1 with the housing located at different inclined positions relative to the trolley.

Pivoting the housing into the open position relative to trolley 3, that is, a lift off of the housing 1 from the depth stop 18, is impossible, although spring 7 disposed between the housing 1 trolley 3 is under prestress. After the locking switch is release, the locking pawl 12 returns to its original position as shown in FIG. 2, whereby the locking action between the stop 14 on the locking pawl 12 and the locking edge 21 on the locking arm 28 is cancelled. Accordingly, the apparatus can again assume its initial position, with the housing 1 pivoted away from the trolley 3 as shown in FIG. 1.

While specific embodiments of the invention have been shown and described in detail to illustrate the inventive principles, it will be understood that the invention may be embodied otherwise without departing from such principles.

We claim:

1. A masonry slitting apparatus comprises a housing (1) including a first and a second end spaced from said first end and a pair of sides extending between said first and second ends, with a first handle (10) at said first end and a second handle (9) at said second end, a drive unit (2) positioned in said housing for driving a slitting tool (4), said slitting tool comprising at least one slitting disk (5) having a disk plane extending transversely of the said first and second ends, a trolley (3) having a first end region and a second end region with a rotary bearing (6) located in said first end region, said housing being pivotally mounted on said trolley about said rotary bearing (6) against a biasing force of a spring (7) located in said first end region, said trolley (3) having a locking rail (17) in said second end region thereof projecting towards said housing, an adjustable depth stop (18) mounted on said locking rail (17), a locking pawl (12) mounted on said housing (1) at the second end thereof and arranged to cooperate with said locking rail (17), a locking switch (11) disposed in one of said handles for actuating said locking pawl (12), and said depth stop means on (18) for displacement into locking engagement with said locking pawl (12)

when said locking switch remains actuated, wherein additional force is not required to be applied to said handles for maintaining said slitting tool in engagement with a masonry surface to be slit.

2. A masonry slitting apparatus, as set forth in claim 1, wherein said means on depth stop (18) comprises a locking arm (28) projecting towards said locking pawl (12) and arranged to cooperate with a stop (14) on said locking pawl (12).

3. A masonry slitting apparatus, as set forth in claim 1 or 2, wherein said locking pawl (12) has a guidance surface (15) arranged to contact said locking arm (18) for effecting resilient yielding of said locking arm (28).

4. A masonry slitting apparatus comprises a housing (1) including a first and a second end spaced from said first end and a pair of sides extending between said first and second ends, with a first handle (10) at said first end and a second handle (9) at said second end, a drive unit (2) positioned in said housing for driving a slitting tool (4), said slitting tool comprising at least one slitting disk (5) having a disk plane extending transversely of the said first and second ends, a trolley (3) having a first end region and a second end region with a rotary bearing (6) located in said first end region, said housing being pivotally mounted on said trolley about said rotary bearing (6) against a biasing force of a spring (7) located in said first end region, said trolley (3) having a locking rail (17) in said second end region thereof projecting towards said housing, an adjustable depth stop (18) mounted on said locking rail (17), a locking pawl (12) mounted on said housing (1) at the second end thereof and arranged to cooperate with said locking rail (17), a locking switch (11) disposed in one of said handles for actuating said locking pawl (12), and said depth stop (18) being displaceable into locking engagement with said locking pawl (12), wherein said depth stop (18) comprises a locking arm (28) projecting towards said locking pawl (12) and arranged to cooperate with a stop (14) on said locking pawl (12), said locking pawl (12) has a guidance surface (15) arranged to contact said locking arm (18) for effecting resilient yielding of said locking arm (28), a spacing (A1) located between a stop face 27 on said depth stop (18) facing toward said locking pawl (12) and a stop edge (21) on said locking arm (28) corresponds at least to a spacing (A2) between a boundary face (26) on said housing (1) facing said depth stop (18) and the stop (14) on said locking pawl (12).

5. A masonry slitting apparatus, as set forth in claim 4, wherein said locking arm is formed of spring steel.

* * * * *

UNITED STATES PATENT AND TRADEMARK OFFICE

CERTIFICATE OF CORRECTION

PATENT NO. : 5,676,126
DATED : October 14, 1997
INVENTOR(S) : Hans Rupprecht, et. al.

It is certified that error appears in the above-identified patent and that said Letters Patent is hereby corrected as shown below:

Title page, item [73], Assignee: should read--

Hilti Aktiengesellschaft, Fürstentum,--
Liechtenstein

Signed and Sealed this

Thirteenth Day of January, 1998

*Attest:*

*Attesting Officer*

BRUCE LEHMAN

*Commissioner of Patents and Trademarks*